US007381875B2

(12) United States Patent
Berschneider

(10) Patent No.: US 7,381,875 B2
(45) Date of Patent: Jun. 3, 2008

(54) HARMONICA HORN

(76) Inventor: Rolf Berschneider, 10724 Wilshire Blvd., Los Angeles, CA (US) 90024

( * ) Notice: Subject to any disclaimer, the term of this patent is extended or adjusted under 35 U.S.C. 154(b) by 0 days.

(21) Appl. No.: 11/100,867

(22) Filed: Apr. 6, 2005

(65) Prior Publication Data

US 2006/0225557 A1 Oct. 12, 2006

(51) Int. Cl.
*G10D 7/02* (2006.01)

(52) U.S. Cl. ..... 84/379

(58) Field of Classification Search ..... 84/377, 84/378, 379

See application file for complete search history.

(56) References Cited

U.S. PATENT DOCUMENTS

| | | | | |
|---|---|---|---|---|
| 712,380 | A | 10/1902 | Hohner | |
| 752,295 | A | 2/1904 | Messner | |
| 1,705,076 | A * | 3/1929 | Strauss | 84/378 |
| 4,091,703 | A * | 5/1978 | Adamitis | 84/378 |
| 4,397,213 | A | 8/1983 | Hubbard | |
| 4,739,686 | A | 4/1988 | Doll | |
| 4,984,499 | A * | 1/1991 | Schille | 84/734 |
| D367,877 | S | 3/1996 | Hayashi | |
| 6,291,751 | B1 | 9/2001 | Antaki | |

OTHER PUBLICATIONS

Horner, http/www.ginab.com/rbharper/images/tromp3.jpg , Hohner Trumpet call.

* cited by examiner

*Primary Examiner*—Kimberly Lockett
(74) *Attorney, Agent, or Firm*—Samuel L. Alberstadt

(57) ABSTRACT

The present invention is a harmonica horn that can be releasably mounted to a harmonica. The invention includes a bell or horn portion, a sound chamber, and a means for releasably mounting the harmonica. Each note of the harmonica, when played, results in air moving in the sound chamber, yet the harmonica horn and the harmonica remain stationary relative to each other.

6 Claims, 3 Drawing Sheets

HARMONICA HORN

FIELD OF THE INVENTION

This invention relates to devices for improving and amplifying the sound of a harmonica. More specifically, it relates to a device that can be releasably mounted to a harmonica, and while the harmonica is being played, the device remains stationary in relation to the harmonica.

BACKGROUND OF THE INVENTION

Since the harmonica was invented in the $19^{th}$ century, harmonica designers and players alike have tried to improve and amplify the instrument's sound. Typically these attempts have focused on the diatonic harmonica, which is designed to play a single major scale in what is known as first position, while other scales or portions of scales, in both major and minor modes, can be played in second, third, fourth position, etc.

The modern diatonic harmonica somewhat like the one depicted in U.S. Pat. No. 367,877 to Hayashi and assigned to Tombo Musical Instrument Company. The typical diatonic harmonica consists of a comb, two reed plates on either side of the comb, and cover plates on either side of the reed plates. Such a configuration is depicted in FIG. 1 of U.S. Pat. No. 6,359,204 to Antaki.

Various aspects of the harmonica design affect its sound and performance. For example, combs can be made of wood, plastic, or solid metal like brass or aluminum. The shape and material of the cover plates can also be significant. So, too, can the sealing of the reed plates on the comb and the sealing of the cover plates.

Various attempts have been made to improve and amplify the sound of a diatonic harmonica. U.S. Pat. No. 752,295 to Messner depicts a pair of tapered cover plates that form a horn-like opening on one end of the harmonica. A variation on the Messner harmonica appears in U.S. Pat. No. 712,380 to Hohner, where the cover plates are formed into one integral piece and bulged into the form of a cup at the backside of the harmonica. In Hohner, the cover or resonance chamber extends an appreciable distance beyond the bottom of the reed plates and is pear shaped in transverse section.

More recently, Antaki, in U.S. Pat. No. 6,291,751 describes a single cover structure or enclosure that surrounds the harmonica, which is purported to enhance the harmonica tone and increase the loudness of the sound produced by the harmonica. Antaki discloses single-piece and multi-piece enclosures. Hohner previously manufactured a harmonica called the Trumpet Call. These harmonicas each included multiple horn portions attached to a single diatonic harmonica. Thus, if a harmonica player desired a horn to modify the sound of his diatonic harmonica, he would still need a different harmonica with permanently mounted horns for each key.

Prior to Antaki, Adamitis, in U.S. Pat. No. 4,091,703, disclosed a shaped hollow resonating horn slidably mounted to the harmonica. The horn was sized to enclose one or more outlet holes of the harmonica, and slid along a groove on the outside of the harmonica to fit over a selected group of adjacent outlet holes associated with specific reeds for specific notes. According to Adamitis, his invention produced an echo of a desired musical cord when the harmonica was played.

Unrelated to efforts to improve and amplify harmonica sounds, various devices have been used with the harmonica to secure it in place. Most notable are the types of harmonica mounts or braces used by guitar players who simultaneously play the harmonica and the guitar, including well-known musicians like Bob Dylan or Neil Young. Other harmonica holders are described in patents such as U.S. Pat. No. 4,397,213 to Hubbard, for a harmonica holder and shroud used to clamp a harmonica to a microphone. Another such harmonica holding device is described in U.S. Pat. No. 4,739,686 to Doll. The holder includes a base portion adapted to be attached to a neck harness, and also includes two struts that terminate in narrow lateral spaces at the ends of the holder to secure the ends of the harmonica.

Despite the various attempts in the prior art, there remains a need for a device that can provide an amplified and warmer tone for the harmonica. There also remains a need for such a device from which the harmonica can be easily mounted and removed and yet which remains stationary relative to the harmonica while the harmonica is being played and provides amplified and improved tone for all of the notes of the harmonica.

SUMMARY OF THE INVENTION

The present invention solves many of the problems encountered in the prior art. The present invention is a harmonica horn to which a harmonica can be easily mounted and from which it can be removed. This is especially important for diatonic harmonicas, since a harmonica player will likely use numerous diatonic harmonicas of different keys during the course of performing during an evening. Unlike the harmonica horn of Adamitis, U.S. Pat. No. 4,091,703, the present invention exchanges air through all of the outlet holes of the harmonica, rather than a select few. Moreover, unlike Hohner and Messner, the present invention provides a horn whose sound is much less dependant on which note of the harmonica has been played, because in this prior art the horn portion was at one end of the harmonica.

In one embodiment, the harmonica horn of the present invention includes a bell portion, a sound chamber fixed to the bell portion and disposed between the bell portion and the harmonica and adapted to exchange air with each harmonica hole; and, also includes a means for releasably mounting the harmonica to the sound chamber so that the harmonica and the sound chamber remain stationary relative to each other while the harmonic is being played. The means for releasably mounting the harmonica to the sound chamber can include any one of a number of embodiments. For example, the mounting means can simply comprise two edges that are adapted so that a harmonica can be slidably mounted into and secured relative to the sound chamber. Alternatively, one of the edges can be moveable and operatively connected to a spring, so that the edge can be moved up and down to clamp a harmonica between the two edges.

Additional features and advantages of the present invention will become apparent when considered in conjunction with the accompanying drawings and the detailed description below.

BRIEF DESCRIPTION OF THE DRAWINGS

FIG. 1 depicts the harmonica horn 20 of the present invention. The horn includes a bell portion 22 which those of skill in the art will understand can also be called a horn portion or simply a horn. The meaning of the term will be clear from its context. The bell portion 22 tapers backward to sound chamber 30. A prototype of the present invention was made from portions of metallic wind instruments, resulting in the design depicted in FIG. 1. That design includes the bell portion 22 and a transition portion 24 that connects bell portion 22 to sound chamber 30. Braising or welding was used to connect the bell portion 22, transition portion 24, and sound chamber 30, with those connections covered by straps or clamps 26. It is not contemplated that the structure of the invention be limited by either the described structure or the method of construction. The harmonica horn may be integrally formed or cast, or may be welded or braised of as many parts as may be necessary.

FIG. 2 depicts a rectangular sound chamber 30 with ears 32 at either end. A preferred embodiment of the means for releasably mounting the harmonica 40 is depicted as having two edges, 46*a* and 46*b*. Edge 46*b* is formed integrally with sound chamber 30, while edge 46*a* is movably attached to spring and hinge 42. A thumb tab 44 allows edge 46*a* to be moved easily upward while harmonica 10 is fitted against sound chamber 30. In the embodiment depicted in FIG. 2, the ends 16 of comb 12 of harmonica 10 fits snugly between ears 32 at the end of sound chamber 30.

Figure 1:
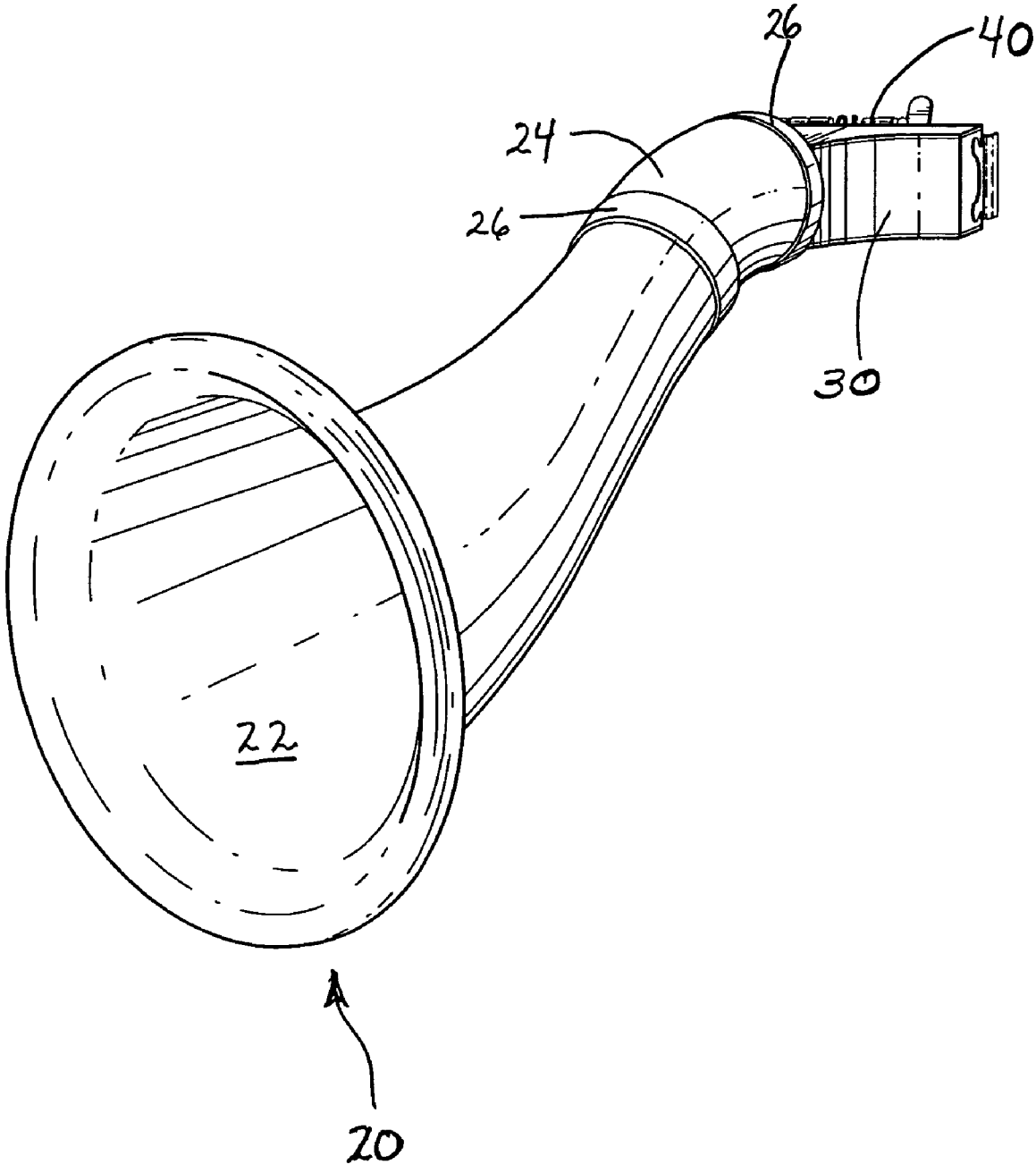
FIG. 1 is a perspective view of the harmonica horn looking from the opening at the bell and toward the sound chamber.
Figure 2:
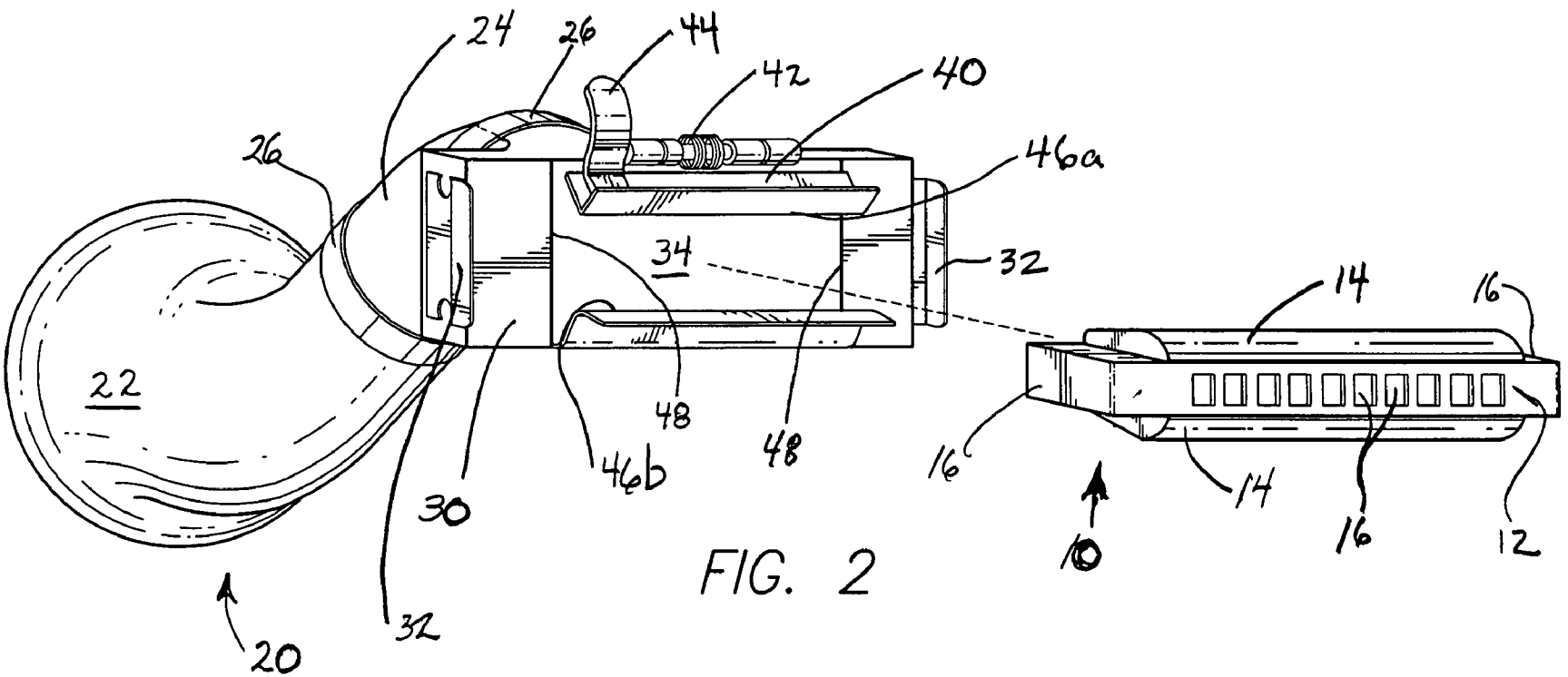
FIG. 2 is a perspective view of the harmonica horn from behind, looking at a diatonic harmonica that can be mounted to the sound chamber which then transitions into the bell end of the device.
Figure 3:
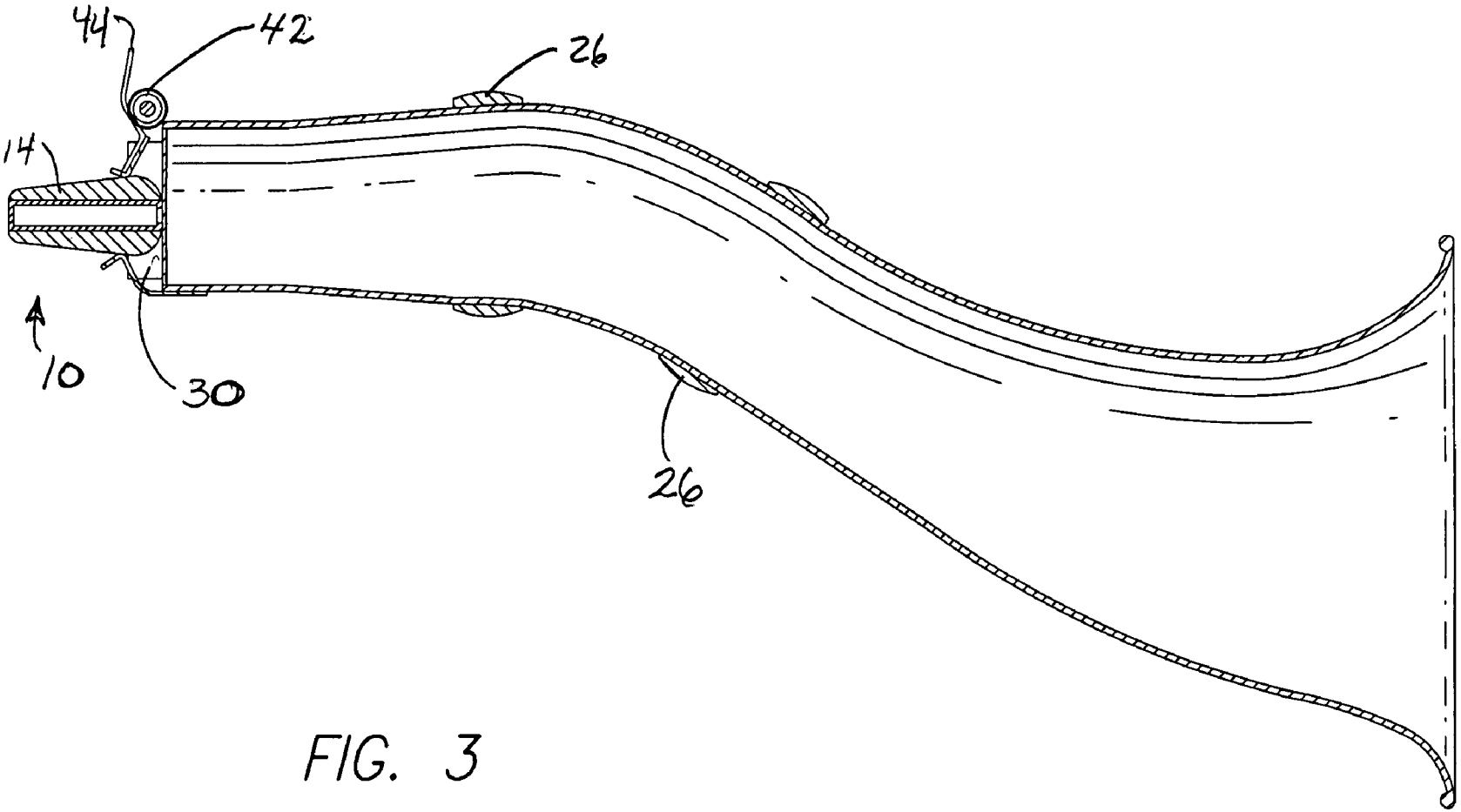
FIG. 3 is an elevation view of the harmonica horn over its entire length, also depicting a harmonica mounted to the horn.

Harmonica 10 includes ten holes 16, a typical diatonic configuration. The holes 16 through which a harmonica player blows and draws have corresponding holes on the other side of the harmonica, (on the other side of the harmonica, not shown) all of which fit inside opening 34 of sound chamber 30.

The bell portion 22 or horn of the present invention, which can also include transition portion 24, is designed so that the horn and bell portion curve downwardly. This provides better vision for the harmonica player. If the horn or bell portion 22 came straight out of sound chamber 30, such that the horn and sound chamber axis represented a horizontal line parallel to the floor upon which a harmonica player stood, then the outside rim of bell portion 22 could conceivably obstruct the view of the harmonica player. That obstruction would remain permanent because the horn would turn as the harmonica player turned. Therefore, the harmonica player could see neither the audience nor his fellow musicians, because his view would be blocked by the bell portion.

The present invention contemplates numerous embodiments. For example, the material from which the horn and sound box are made can be plastic or various grades of metal, depending upon price constraints. Similarly, the means for releasably mounting the harmonica is not limited to the embodiment depicted in the drawings. For example, the two edges 46*a* and 46*b* could be fixed, and the cover plates 14 of harmonica 10 could be adapted to engage the edges as the harmonica is slid between them. Although seemingly less desirable, it is intended that the present invention could include such embodiments where a separate spring or clip (not shown) would be used to attach the ends 16 of harmonica ten to sound box 30. Also, although the present invention is described in terms of the typical 10 hole diatonic harmonica, it should not be so limited. For example the sound box 30 and the means for releasably mounting 40 could be adapted to hold twelve and sixteen hole harmonicas, as well as a chromatic harmonica, a bass harmonica, or any other kind of similar instrument.

One of the significant problems in playing a harmonica is the leakage of air. For example, in the diatonic and chromatic harmonicas, air can leak from between the comb and the plates or between the cover plates and the comb. Such problems could extend to the present invention which could have leaks between harmonica 10 and either sound chamber 30 or means for releasably mounting 40. To prevent such leaks, one could use felt or a similar material on edges 46*a* and 46*b* to ensure that no air leaked between mounting means 40 and the cover plate 14 of harmonica 10. Moreover, the v-shaped surfaces that intersect in edges 46*a* and 46*b* could be flattened to provide better leak prevention and an improved grip of the harmonica. In addition, structures or insulating materials could be placed on edges 48 of opening 34 in sound chamber 30.

Therefore, in the spirit of the broad description of the invention, the invention is defined in the following claims:

What is claimed:

1. A harmonica horn for releasable mounting to a reeded, commercially available harmonica with holes for blowing and drawing air over the reeds, comprising:

a horn portion with a bell end and a harmonica end, the bell end and harmonica end each having an axis generallv parallel to the blow and draw holes of the harmonica;

a sound chamber with a harmonica end, the sound chamber being connected to the harmonica end of the horn portion, the harmonica end of the sound chamber configured to exchange air with each hole of the harmonica; and, a harmonica holder, including two edges generally parallel to the harmonica and adapted to releasably mount the harmonica to the sound chamber so that the harmonica and the horn portion are stationary relative to each other while the harmonica is being played, the harmonica holder further including a spring operatively connected to one of the edges of the holder and a tab for variably moving the edge connected to the spring so the harmonica holder can hold any one of a plurality of commercially available harmonicas.

2. The harmonica horn of claim 1, further comprising insulation mounted on the edges to prevent air from leaking between the sound chamber and the harmonica.

3. The harmonica holder of claim 1, wherein the horn portion is curved downwardly from the harmonica end toward the bell end of the horn portion.

4. The harmonica holder of claim 3, wherein the sound chamber and the harmonica holder are adapted to hold a diatonic harmonica.

5. The harmonica holder of claim 3, wherein the sound chamber and the harmonica holder are adapted to hold a chromatic harmonica.

6. The harmonica horn of claim 1, wherein the spring is operatively connected to the harmonica and to the two edges.

* * * * *